US010396442B2

(12) United States Patent
Elghannai

(10) Patent No.: US 10,396,442 B2
(45) Date of Patent: Aug. 27, 2019

(54) EAR-WORN ELECTRONIC DEVICE INCORPORATING COMBINED DIPOLE AND LOOP ANTENNA

(71) Applicant: Starkey Laboratories, Inc., Eden Prairie, MN (US)

(72) Inventor: Ezdeen Elghannai, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/824,066

(22) Filed: Nov. 28, 2017

(65) Prior Publication Data

US 2019/0165456 A1 May 30, 2019

(51) Int. Cl.
*H01Q 1/27* (2006.01)
*H01Q 7/00* (2006.01)
*H01Q 9/26* (2006.01)

(52) U.S. Cl.
CPC ..... *H01Q 1/273* (2013.01); *H01Q 7/00* (2013.01); *H01Q 9/26* (2013.01); *H04R 2225/51* (2013.01)

(58) Field of Classification Search
CPC ..... H01Q 1/526; H01Q 1/273; H01Q 7/00; H01Q 9/26
USPC ..... 343/841, 718, 726, 895
See application file for complete search history.

(56) References Cited

U.S. PATENT DOCUMENTS 7,450,078 B2 * 11/2008 Knudsen ..... H01Q 1/273 343/702
7,593,538 B2 * 9/2009 Polinske ..... H01Q 1/22 381/312
9,319,807 B2 4/2016 Meskens et al.
9,661,426 B2 5/2017 Ozden
9,722,306 B2 8/2017 So et al.
9,888,327 B2 * 2/2018 Nikles ..... H01Q 1/273
2005/0090284 A1 * 4/2005 Yuanzhu ..... H01Q 1/22 455/558
2010/0103061 A1 * 4/2010 Yung ..... H01Q 7/00 343/730
2010/0283694 A1 * 11/2010 Kato ..... G06K 19/07749 343/730
2011/0090060 A1 * 4/2011 Tavshikar ..... G06K 7/0004 340/10.3

(Continued)

FOREIGN PATENT DOCUMENTS

DE 102008022127 * 11/2009 ..... H01Q 7/00

OTHER PUBLICATIONS

2015 Elghannai et al., "Modal-Based Approach to Tune and Enhance the Frequency and Dielectric Bandwidth of a UHF-RFID Tag Antenna Mounted on a Dielectric Substrate", IEEE, 2015, pp. 161-162.

(Continued)

*Primary Examiner* — Lam T Mai
(74) *Attorney, Agent, or Firm* — Hollingsworth Davis, LLC

(57) ABSTRACT

An ear-worn electronic device comprises an enclosure and electronics positioned in the enclosure. A power source is disposed in the enclosure and coupled to the electronics. An antenna is disposed in or supported by the enclosure and coupled to the electronics. The antenna comprises a dipole antenna combined with a loop antenna. An input impedance of the antenna remains substantially constant over a predetermined dielectric constant bandwidth and a predetermined frequency bandwidth.

20 Claims, 9 Drawing Sheets

(56) References Cited

U.S. PATENT DOCUMENTS

| | | | | |
|---|---|---|---|---|
| 2014/0319225 | A1* | 10/2014 | Van Rens | G06K 19/07758 235/488 |
| 2017/0170677 | A1* | 6/2017 | Park | H02J 7/025 |
| 2017/0192743 | A1* | 7/2017 | Chun | H04W 76/14 |
| 2017/0256843 | A1* | 9/2017 | Hu | H01Q 1/243 |
| 2017/0256854 | A1* | 9/2017 | Hu | H01Q 1/243 |
| 2018/0316082 | A1* | 11/2018 | Keller, III | H01Q 1/2275 |

OTHER PUBLICATIONS

2014 Shao et al., "Physics-Based Approach for Antenna Design Optimization of RFID Tags Mounted on and Inside Material Layers", IEEE, 2014, pp. 1676-1677.

* cited by examiner

EAR-WORN ELECTRONIC DEVICE INCORPORATING COMBINED DIPOLE AND LOOP ANTENNA

TECHNICAL FIELD

This application relates generally to ear-worn electronic devices, including hearing devices, hearing aids, personal amplification devices, and other hearables.

BACKGROUND

Hearing devices provide amplified sound for the wearer. Some examples of hearing devices are headsets, hearing aids, in-ear monitors, cochlear implants, bone conduction devices, and personal listening devices. For example, hearing aids provide amplification to compensate for hearing loss by transmitting amplified sounds to the ear canals. Hearing devices can incorporate a radio coupled to an antenna. Antenna performance can vary significantly from one wearer to another, due to variations in head geometry, size, and material properties.

SUMMARY

Embodiments are directed to an ear-worn electronic device comprising an enclosure and electronics positioned in the enclosure. A power source is disposed in the enclosure and coupled to the electronics. An antenna is disposed in or supported by the enclosure and coupled to the electronics. The antenna comprises a dipole antenna combined with a loop antenna. An input impedance of the antenna remains substantially constant over a predetermined dielectric constant bandwidth and a predetermined frequency bandwidth.

Embodiments are directed to an ear-worn electronic device comprising an enclosure and electronics positioned in the enclosure. A power source is disposed in the enclosure and coupled to the electronics. A folded antenna is disposed in or supported by the enclosure and coupled to the electronics. The folded antenna comprises a loop antenna combined with a dipole antenna. The loop antenna comprises a first loop and a second loop. The dipole antenna is combined with the loop antenna and disposed between the first loop and the second loop. A first gap is defined between the first loop and the dipole antenna, and a second gap is defined between the second loop and the dipole antenna.

The above summary is not intended to describe each disclosed embodiment or every implementation of the present disclosure. The figures and the detailed description below more particularly exemplify illustrative embodiments.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
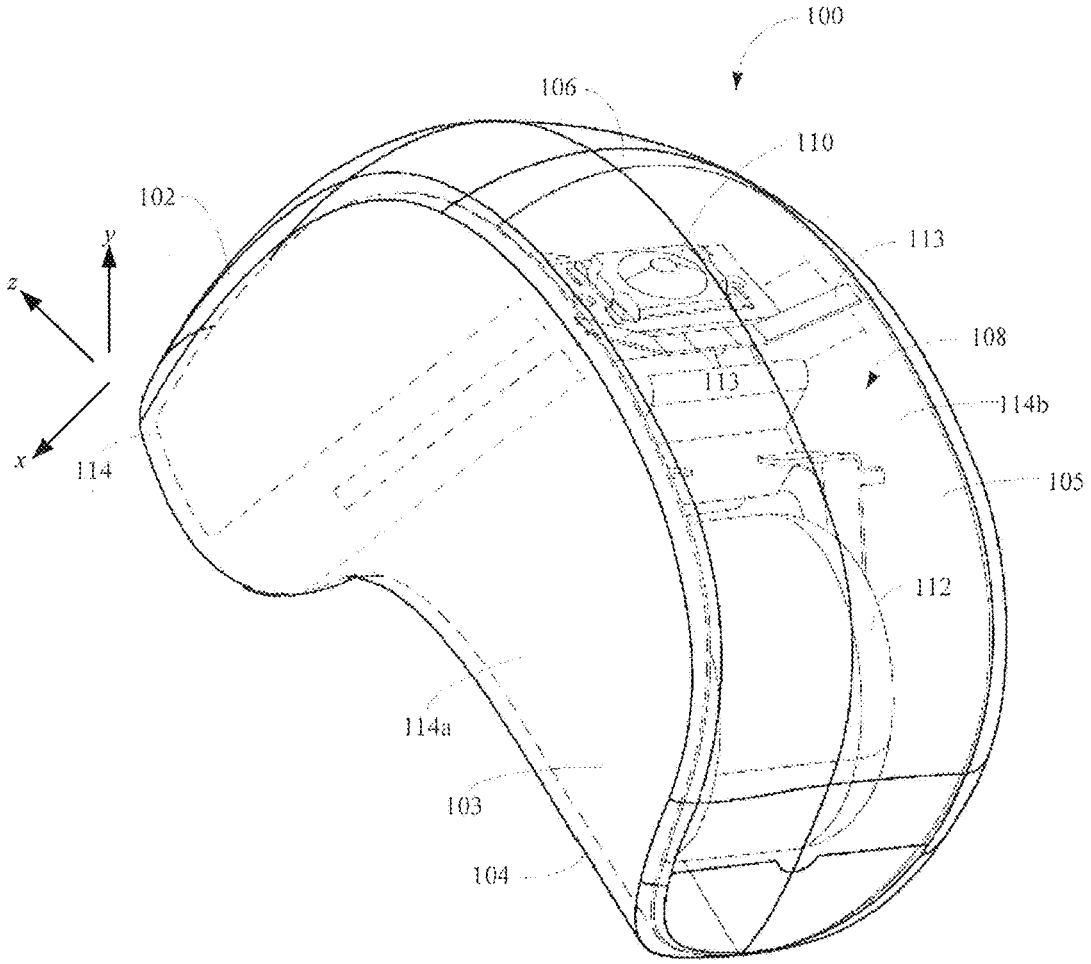
FIG. 1 illustrates a representative ear-worn electronic device that incorporates a combined dipole-loop antenna in accordance with various embodiments.

It is understood that the embodiments described herein may be used with any ear-worn electronic device without departing from the scope of this disclosure. The embodiments depicted in the figures are intended to demonstrate the subject matter, but not in a limited, exhaustive, or exclusive sense. It is understood that the present subject matter can be used with a device designed for use in or on the right ear or the left ear or both ears of the wearer.

The term ear-worn electronic device of the present disclosure refers to a wide variety of ear-level electronic devices that can aid a person with impaired hearing. The term ear-worn electronic device also refers to a wide variety of devices that can produce optimized or processed sound for persons with normal hearing. Ear-worn electronic devices of the present disclosure include hearables (e.g., wearable earphones, headphones, in-ear monitors, earbuds, virtual reality headsets), hearing aids (e.g., hearing instruments), cochlear implants, and bone-conduction devices, for example. Ear-worn electronic devices include, but are not limited to, behind-the-ear (BTE), in-the-ear (ITE), in-the-canal (ITC), invisible-in-canal (ITC), receiver-in-canal (RIC), receiver-in-the-ear (RITE) or completely-in-the-canal (CIC) type hearing devices or some combination of the above. Throughout this disclosure, reference is made to an "ear-worn electronic device," which is understood to refer to a system comprising a left ear device or a right ear device or a combination of a left ear device and a right ear device.

A significant challenge that impacts the design and performance of an antenna of an ear-worn device is the loading introduced by the human head being immediately next to the antenna. An antenna, when placed next to the head of the wearer of the ear-worn electronic device, will experience a shift in impedance. If this shift in impedance is too large to account for, the wireless communication at the desired frequency will either operate with degraded performance or become inoperable. Head loading is highly variable from one wearer to another, since it depends on head geometry, size, and material properties. This makes it difficult to design an antenna of an ear-worn electronic device that can accommodate a wide range of head loading variability. Although an antenna of an ear-worn electronic device can be optimized for given head properties and size, in most practical cases, these properties are not known apriori. It is therefore important to design antennas whose performance is not negatively affected by variations in head loading. This results in antenna with constant performance regardless of a wearer's unique head geometry, size, and material properties.

Embodiments of the disclosure are directed to a wideband antenna for use in an ear-worn electronic device. The term wideband refers not only to frequency but to human head dielectric changes. Embodiments are directed to an antenna of an ear-worn electronic device based on a combined structure of a dipole antenna and a loop antenna. In some embodiments, the combined dipole-loop antenna structure can be coupled to a matching network. In other embodiments, a matching network can be excluded. When both the dipole and loop structures are tuned for the desired frequency and dielectric constant, a wideband combined dipole-loop antenna (in terms of frequency and dielectric) can be achieved. A combined dipole-loop antenna can be self-tuned and, more importantly, is substantially insensitive to dielectric change and thus head loading.

Figure 4:
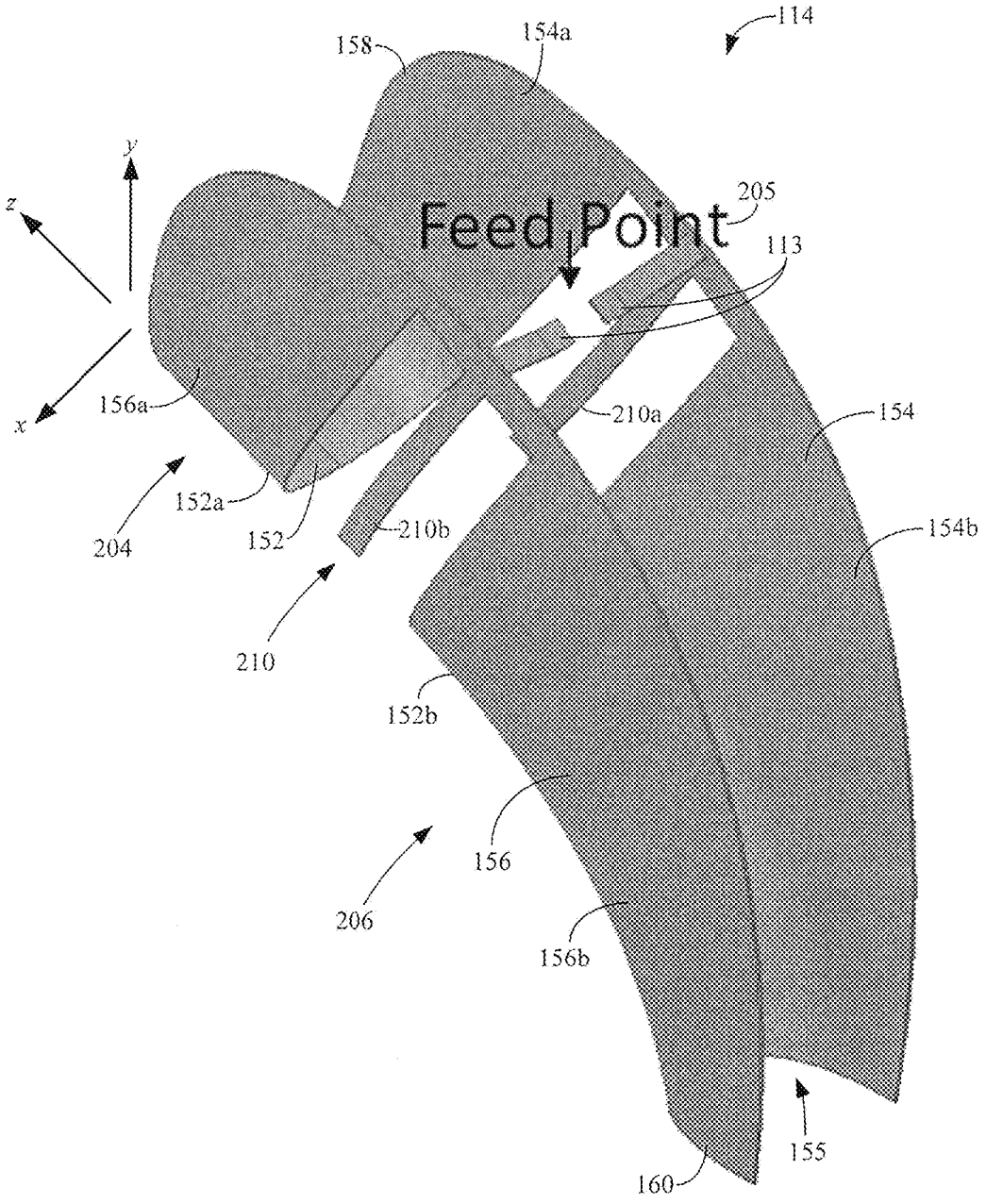
FIG. 4 shows a combined dipole-loop antenna in accordance with various embodiments.
Figure 5:
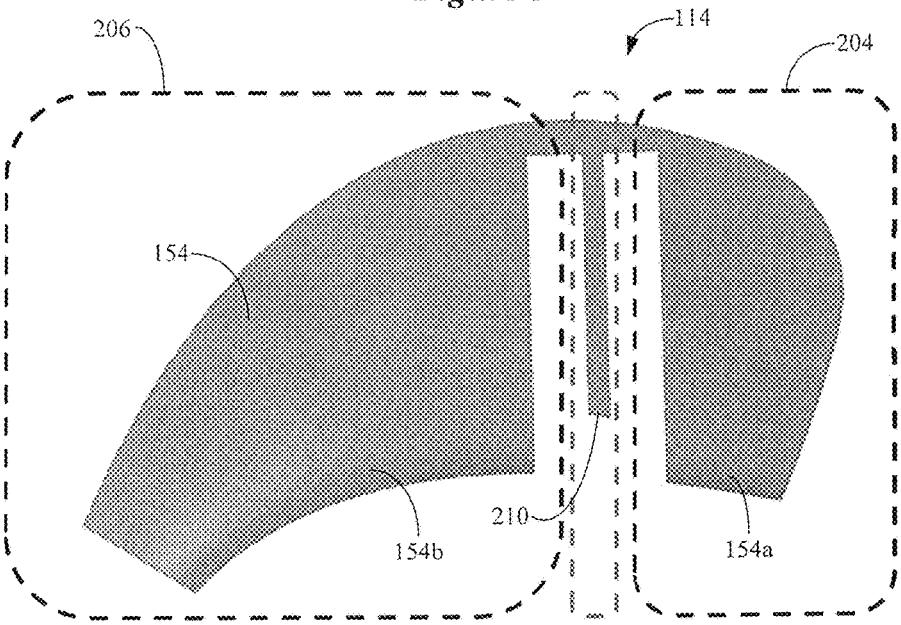
FIG. 5 is a side view of the combined dipole-loop antenna shown in FIG. 4.

FIG. 1 illustrates a representative ear-worn electronic device that incorporates a combined dipole-loop antenna in accordance with various embodiments. In the embodiment shown in FIG. 1, the ear-worn electronic device 100 is of a behind-the-ear (BTE) design. It is understood that a combined dipole-loop antenna of the present disclosure can be incorporated in ear-worn electronic devices 100 having varying configurations. The ear-worn electronic device 100 includes an enclosure 102, referred to as a shell, which includes a first side 103, an opposing second side 105, a bottom 104, and a top 106. A portion 108 of the top 106 is removed in FIG. 1 to show components housed within the shell 102. The internal components of the ear-worn electronic device 100 include electronics 110 coupled to a battery 112. According to some embodiments, the ear-worn electronic device 100 includes an antenna 114 which is coupled to a radio (e.g., 2.4 GHz radio) of the electronics 110 via feed line conductors 113. The antenna 114 is configured as a combined dipole-loop antenna, details of which are shown in FIGS. 4 and 5 according to various embodiments. Elements of the combined dipole-loop antenna 114 are shown on surfaces 114*a* and 114*b* of the antenna 114.

As will be described below, the combined dipole-loop antenna 114 provides for an antenna input impedance that remains substantially constant over a predetermined dielectric constant bandwidth and a predetermined frequency bandwidth. For example, the predetermined dielectric constant bandwidth can include dielectric constants between about 10 and 80 (e.g., between about 20 and 50, such as about 35). The dielectric constant bandwidth preferably includes dielectric constants associated with a wide range of human head geometries, sizes, and material properties. The predetermined frequency bandwidth can include frequencies between about 2.3 and 2.6 GHz (e.g., frequencies within a Bluetooth® band). It is understood that the predetermined frequency bandwidth can be associated with a band other than a Bluetooth® band.

Figure 2:
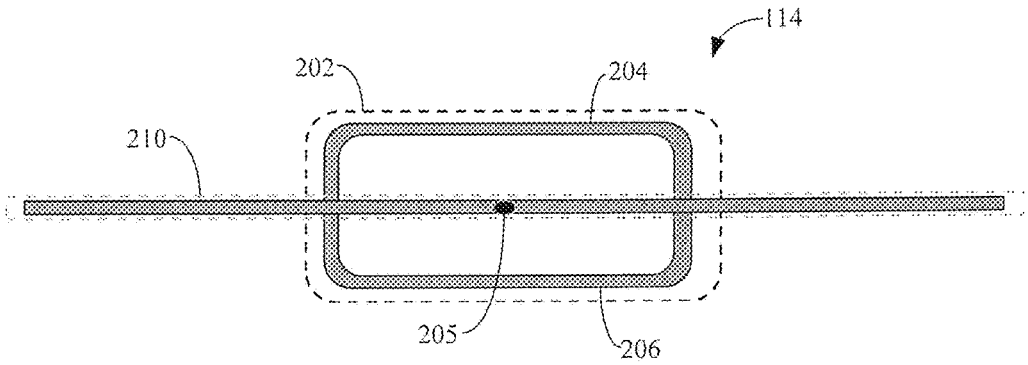
FIG. 2 is a representative illustration of a combined dipole-loop antenna in accordance with various embodiments.

FIG. 2 is a representative illustration of a combined dipole-loop antenna 114 in accordance with various embodiments. FIG. 2 shows the basic structure of the dipole-loop antenna 114, which includes a loop structure 202 and a dipole structure 210. The loop structure 202 includes an upper loop 204 and a lower loop 206. The loop structure 202 and the dipole structure 210 have a common feed point 205. As is shown in other figures, the dipole structure 210 is spaced apart from the upper loop 204 and the lower loop 206 of the loop structure 202.

Figure 3:
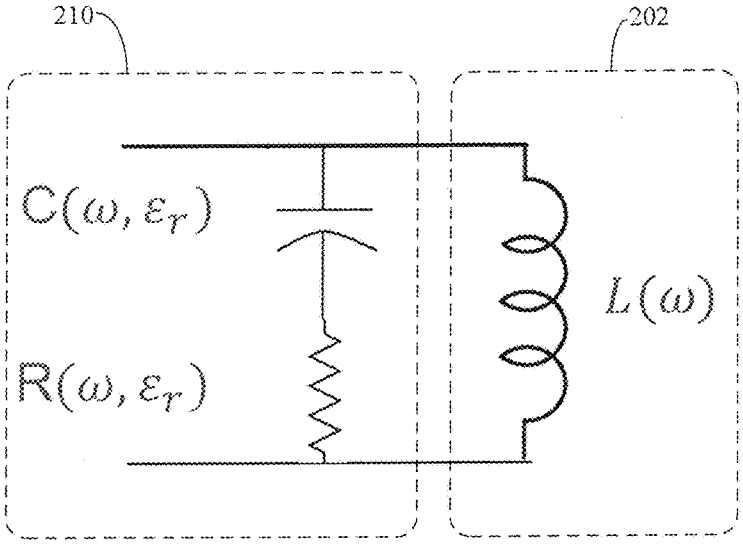
FIG. 3 is an equivalent circuit diagram representing the combined dipole-loop antenna shown in FIG. 2.

FIG. 3 is an equivalent circuit diagram representing the combined dipole-loop antenna 114 shown in FIG. 2. As is shown in FIG. 3, the combined dipole-loop antenna 114 has an inductive mode due to the loop structure 202 and a capacitive mode due to the dipole structure 210. As is indicated in FIG. 3, the capacitive mode due to the dipole structure 210 is sensitive to changes in dielectric constant, and is noticeably detuned due to changes in dielectric constant. The inductive mode due to the loop structure 202 is substantially insensitive to changes in dielectric constant. An important observation was made that the loop structure 202, which corresponds to the inductive mode, can be assumed to be substantially independent of dielectric constant "H-field-based mode." However, the capacitive modes associated with the dipole structure 210 are significantly dependent on dielectric constant "E-field-based mode." As a consequence, the loop structure 202 can be used for tuning the combined dipole-loop antenna 114 at any stage in the design regardless of the dielectric properties.

FIG. 4 shows a combined dipole-loop antenna 114 in accordance with various embodiments. The dipole-loop antenna 114 shown in FIG. 4 is configured as a folded antenna. The dipole-loop antenna 114 has a first end 158, a second and 160, and a belly 152 that extends axially between the first and second ends 158 and 160. The dipole-loop antenna 114 includes opposing first and second sides 154 and 156 that extend from the belly 152 at an angle (e.g., an acute angle). Depending on how the dipole-loop antenna 114 is oriented within the shell of the ear-worn electronic device, the belly 152 can define a bottom or a top of the dipole-loop antenna 114. In the embodiment shown in FIG. 1, for example, the belly 152 defines a bottom of the dipole-loop antenna 114. The opposing sides 154 and 156 of the dipole-loop antenna 114 form an elongated gap 155 that faces the top 106 of the shell 102.

In some embodiments, the dipole-loop antenna 114 can have a deep profile, in which the opposing first and second sides 154 and 156 extend along a major (e.g., >50%) portion or the entirety of the first and second sides 103 and 105 of the shell 102 (e.g., in the y-direction) shown in FIG. 1. In other embodiments, the dipole-loop antenna 114 can have a shallow profile, in which the opposing first and second sides 154 and 156 extend along a minor (e.g., <50%) portion of the first and second sides 103 and 105 of the shell 102. The belly 152 of the dipole-loop antenna 114 can be curved along a longitudinal axis (e.g., along the z-axis in the +/−y-direction) of the antenna 114, allowing the belly 152 to conform to the curvature of the shell 102. The belly 152 can also be curved relative to the longitudinal axis (e.g., left or right of the z-axis in the +/−x-direction) of the dipole-loop antenna 114.

With continued reference to FIG. 4, the dipole-loop antenna 114 includes a dipole 210 and a loop structure comprising an upper loop 204 and a lower loop 206. The upper loop 204 constitutes a first folded portion of the antenna 114 composed of a first region 154*a* of the first side 154, a first region 152*a* of the belly 152, and a first region 156*a* of the second side 156. The lower loop 206 constitutes a second folded portion of the antenna 114 composed of a second region 154*b* of the first side 154, a second region 152*b* of the belly 152, and a second region 156*b* of the second side 156. The dipole 210 is situated between the upper loop 204 and the lower loop 206. The dipole 210 includes a first dipole element 210*a* and a second dipole element 210*b* respectively coupled to a common feed point 205 via feed line conductors 113.

The folded dipole-loop antenna 114 according to some embodiments can be a contiguous unitary structure. For example, the dipole-loop antenna 114 can be a continuous structure that is substantially solid except for apertures needed to accommodate elements of the ear-worn electronic device (e.g., struts, electrical/magnetic components). For example, the dipole-loop antenna 114 can be notched to mitigate interference with near-field coil antennas for other wireless communication systems of the ear-worn electronic device. The shape of the dipole-loop antenna's edge can be optimized to meet industrial design and wireless performance requirements.

In some embodiments, the folded dipole-loop antenna 114 constitutes a stamped metal structure. In other embodiments, the folded dipole-loop antenna 114 constitutes a metal plated structure. For example, the dipole-loop antenna 114 can be plated inside and/or outside of the shell, essentially forming a solid metalized shell. According to other embodiments, the dipole-loop antenna 114 can be a discontinuous structure comprising a multiplicity of connected antenna portions. For example, the dipole-loop antenna 114 can be split into several parts with tight coupling between each part to make the antenna 114 more manufacturable, for example, using flex printed circuit board technology. For example, the folded antenna can comprise a conductive layer on a flexible printed circuit board. By way of further example, the dipole-loop antenna 114 can be a laser direct structuring (LDS) structure.

Figure 6:
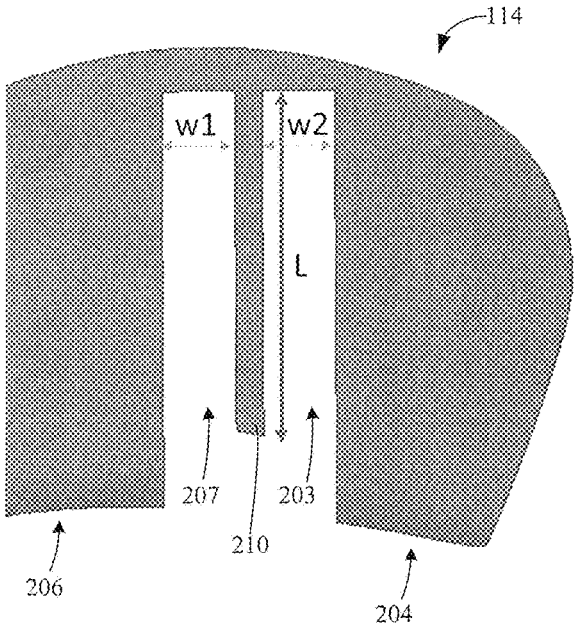
FIG. 6 is an exploded view of a portion of the dipole-loop antenna shown in FIG. 5.

FIG. 5 is a side view of the combined dipole-loop antenna 114 shown in FIG. 4. FIG. 6 is an exploded view of a portion of the dipole-loop antenna 114 shown in FIG. 5. As is best seen in FIG. 5, the dipole-loop antenna 114 includes a lower loop 206, an upper loop 204, and a dipole 210 situated between the lower loop 206 and the upper loop 204. The lower loop 206, upper loop 204, and dipole 210 are merged to form a compact antenna shape.

With reference to FIG. 6, the dipole-loop antenna 114 includes a first gap 207 between the dipole 210 and the lower loop 206. The first gap 207 has a width given by the dimension w1. The antenna 114 includes a second gap 203 between the dipole 210 and the upper loop 204. The second gap 203 has a width given by the dimension w2. The dipole 210 has a length given by the dimension, L.

According to various embodiments, the combined dipole-loop antenna 114 can be designed with a wide frequency and dielectric bandwidth using an approach of tuning the dipole 210 by the upper and lower loops 204 and 206. This design approach involves designing the length, L, of the dipole 210 such that it operates the antenna 114 at a desired frequency, such as 2.45 GHz. The length, L, of the dipole 210 is also designed to obtain a desired real input impedance, such as ~100 Ohm. The width w1 of gap 207 can be varied to control the inductance of the lower loop 206. The width w2 of gap 203 can be varied to control the inductance of the upper loop 204. The width w1 of gap 207 and the width w2 of gap 203 can be selected to tune the dipole-loop antenna 114 to resonance.

As was discussed previously, although the loop inductance is substantially independent of dielectric constant, the dipole capacitance is not. As such, the length, L, of the dipole 210 should be tuned for the desired center frequency and the desired center dielectric constant. It is expected that a dielectric constant variation for the human head is in the range of about 20 to 50. As such, 35 can be used as a center dielectric constant. In the case of a Bluetooth low energy (BLE) band, the center frequency can be 2.45 GHz. Given a center frequency of 2.45 GHz and a center dielectric constant of 35, the length, L, of the dipole 210 can be about 9.6 mm, the width w1 of gap 207 can be about 2 mm, and the width w2 of gap 203 can be about 2 mm. It is reiterated that the loop inductance is substantially insensitive to material changes, and that the loops 204 and 206 help to gain some frequency bandwidth.

Although the BLE frequency band is fairly narrow, the dipole 210 tuned by the loops 204 and 206 is able to cover this bandwidth. In the case of a change in the dielectric constant, the center frequency will shift depending on the nature of the dielectric loading either higher or lower in frequency. In response to an increase in dielectric loading, the center frequency will decrease. In response to a decrease in dielectric loading, the center frequency will increase. Nonetheless, the loops 204 and 206 help to maintain performance and keep the overall performance of the dipole-loop antenna 114 substantially constant.

The combined dipole-loop antenna 114 shown in FIGS. 4-6 was modeled using a center dielectric constant of 35.4 and a center frequency of 2.45 GHz. In the simulation, the dipole 210 had a length of 9.6 mm, and the gaps 203 and 207 between the upper and lower loops 204 and 206 and the dipole 210 were 2 mm wide, respectively. Various data produced from the modeling are shown graphically in FIGS. 7-10. In general, the dipole-loop antenna 114 (positioned next to a human head in the modeling) demonstrated an efficiency of between about −9.175 and −9.539 dB over the BLE band.

Figure 7:
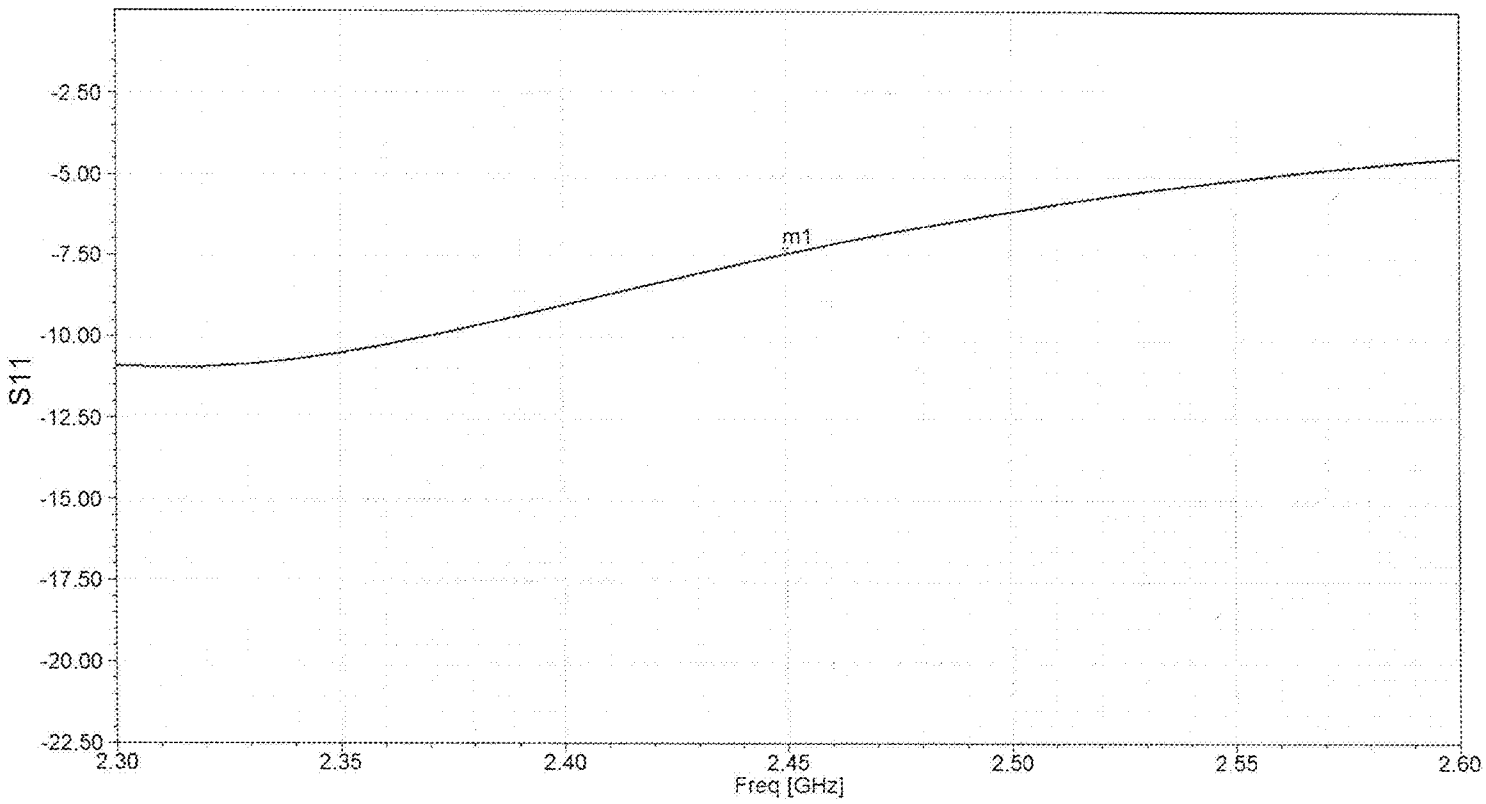
FIG. 7 shows the reflection coefficient, S11, of a modeled dipole-loop antenna as a function of frequency in accordance with various embodiments.

FIG. 7 shows the reflection coefficient, S11, of the modeled dipole-loop antenna 114 as a function of frequency. The dipole-loop antenna 114 was tuned to the BLE frequency band using the dipole 210 and loops 204 and 206 in a manner described above. FIG. 7 clearly demonstrates that the dipole-loop antenna 114 has a good frequency bandwidth. It can be seen that the reflection coefficient, S11, is below −5 dB within the frequency band of 2.3 GHz to about 2.6 GHz. It is noted that the simulation was performed for the left side of the head, with a reference impedance of 100 Ohm.

Figure 8:
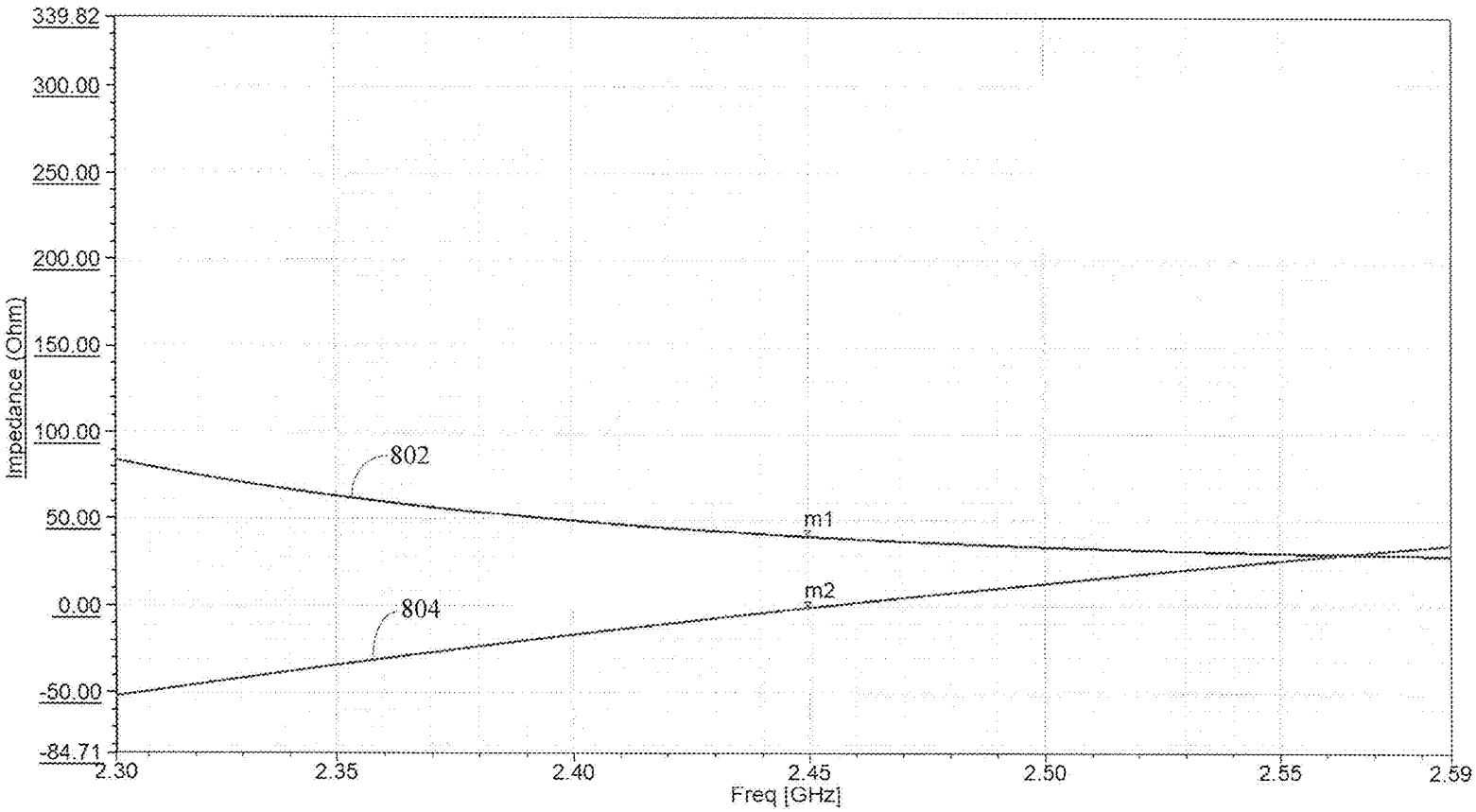
FIG. 8 illustrates the input impedance of a modeled dipole-loop antenna as a function of frequency in accordance with various embodiments.

FIG. 8 illustrates the input impedance of the modeled dipole-loop antenna 114 as a function of frequency. In FIG. 8, curve 802 represents the real part of the input impedance, and curve 804 represents the imaginary part of the input impedance. It is notable that the antenna 114 can be tuned to have an imaginary part of the input impedance of about 0 Ohm. The real part of the input impedance varies between about 30 and 85 Ohm within a frequency band of 2.3 and about 2.6 GHz. This variation in the real part of the input impedance is considered good performance for such a small antenna.

Figure 9:
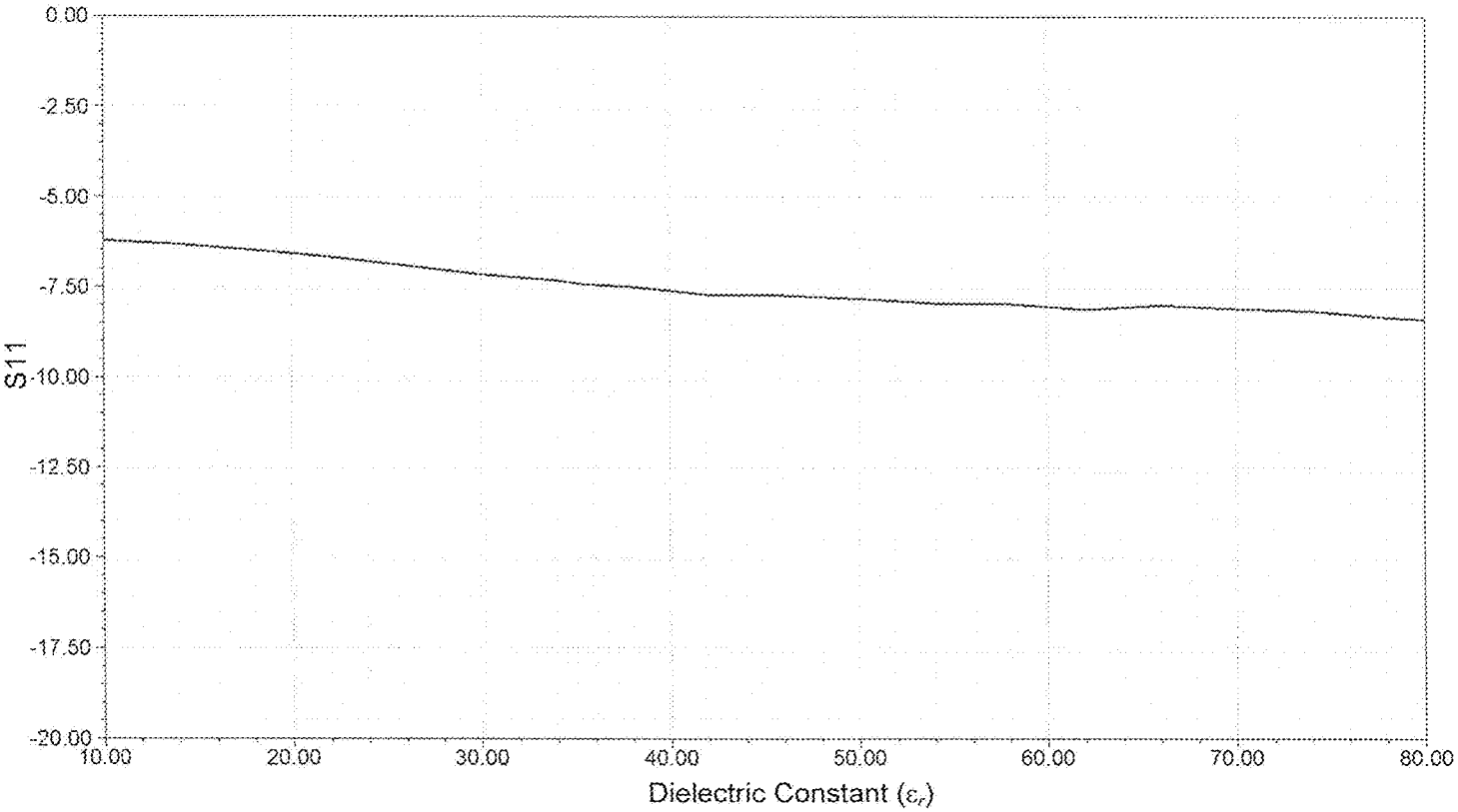
FIG. 9 shows the reflection coefficient, S11, of a modeled dipole-loop antenna as a function of dielectric constant (plotted at 2.45 GHz) in accordance with various embodiments.

FIG. 9 shows the reflection coefficient, S11, of the modeled dipole-loop antenna 114 as a function of dielectric constant (plotted at 2.45 GHz). It can be seen in FIG. 9 that the reflection coefficient, S11, remains substantially constant across a wide dielectric constant range (between 10 and 80). FIG. 9 validates that the reflection coefficient, S11, is not changing appreciably with dielectric changes.

Figure 10:
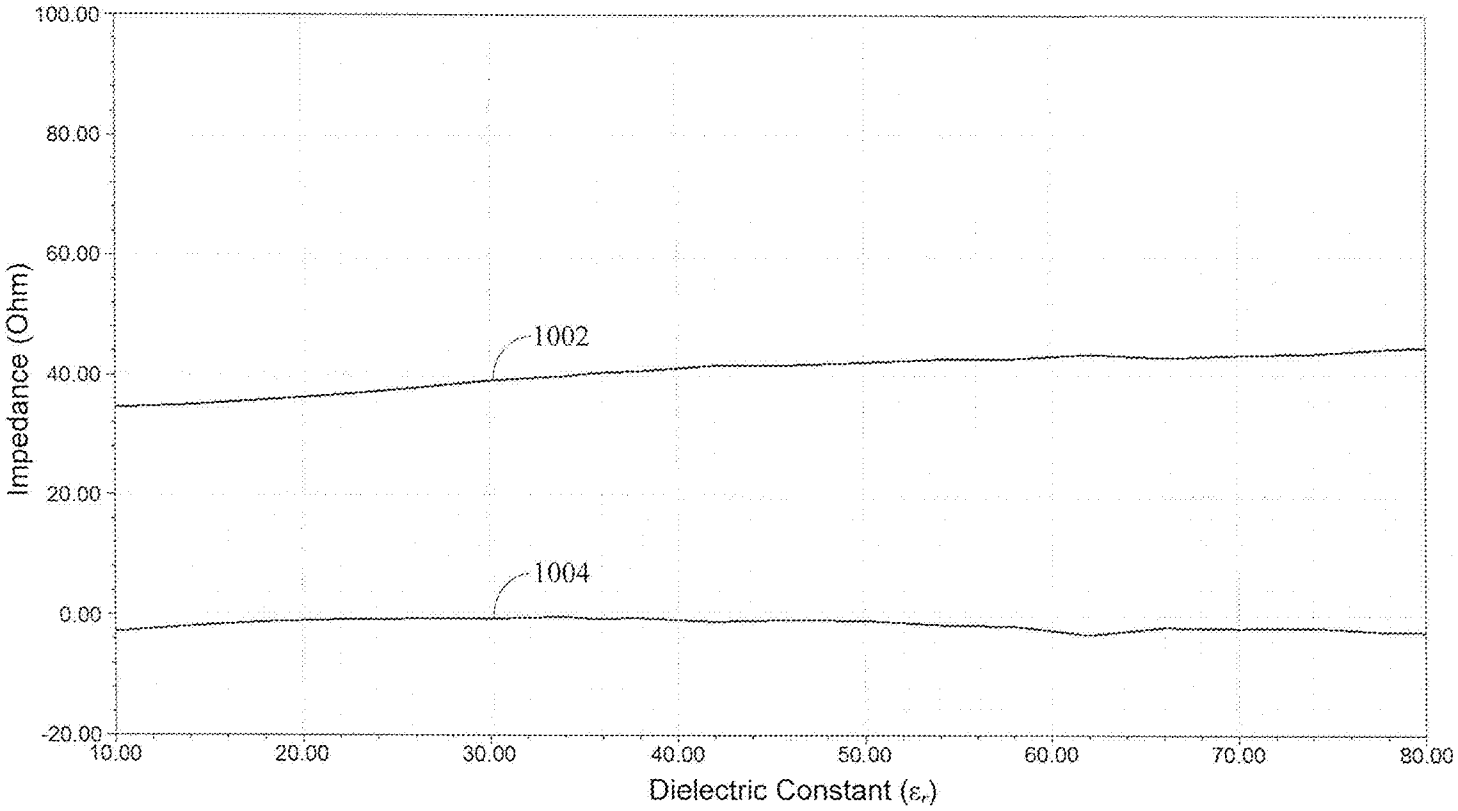
FIG. 10 illustrates the input impedance of a modeled dipole-loop antenna as a function of dielectric constant in accordance with various embodiments.

FIG. 10 illustrates the input impedance of the modeled dipole-loop antenna 114 as a function of dielectric constant. In FIG. 10, curve 1002 represents the real part of the input impedance, and curve 1004 represents the imaginary part of the input impedance. Curves 1002 and 1004 are plotted for a frequency of 2.45 GHz. It can be seen in FIG. 10 that the real and imaginary parts of the input impedance remain relatively constant across a wide range of dielectric constants (between 10 and 80).

FIGS. 9 and 10 demonstrate that the dipole-loop antenna 114 provides relatively constant performance with respect to the reflection coefficient (S11) and input impedance in response to variations in dielectric constant. It is believed that the dielectric variation used in the modeling of the dipole-loop antenna 114 is sufficiently wide to cover most of the human head loading possibilities. The modeling results illustrated in FIGS. 7-10 confirm that the loop component of the dipole-loop antenna 114 assists in providing immunity against changes in human head loading.

An experimental dipole-loop antenna 114 was fabricated and a Total Radiated Power (TRP) measurement was made. In the experiment, no matching network was used. TRP measurements were made for the left and right ear at a number of different frequencies within the BLE band. The experimental TRP measurements are provided below in Table 1. The experimental TRP measurements in Table 1 are in general agreement with simulation TRP measurements.

TABLE 1

| Frequency (MHz) | 2404 | 2420 | 2440 | 2460 | 2478 |
|---|---|---|---|---|---|
| Left (dBm) | −11.19 | −12.62 | −12.15 | −10.31 | −10.75 |
| Right (dBm) | −10.91 | −11.67 | −11.41 | −10.67 | −10.80 |

Figure 11:
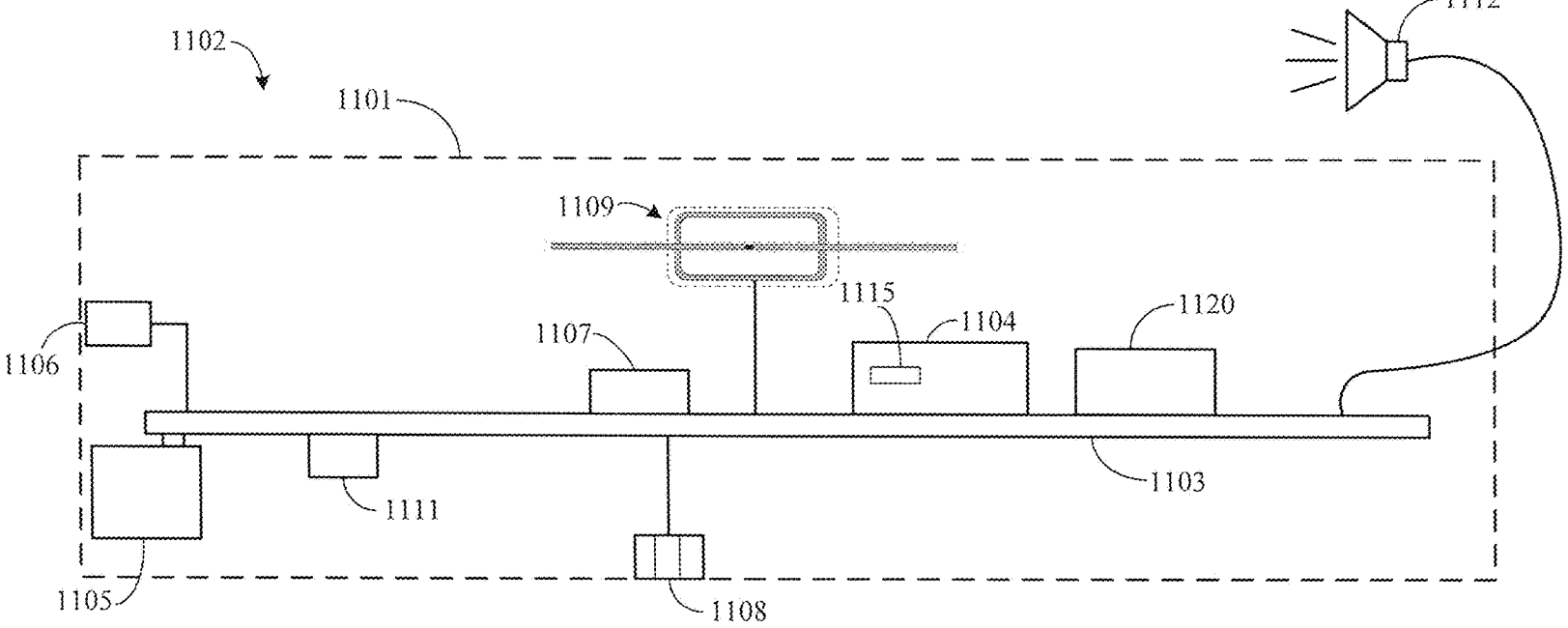
FIG. 11 is a block diagram showing various components that can be incorporated in an ear-worn electronic device in accordance with various embodiments.

FIG. 11 is a block diagram showing various components (e.g., electronics) that can be incorporated in an ear-worn electronic device in accordance with various embodiments. The block diagram of FIG. 11 represents a generic ear-worn electronic device that incorporates a combined dipole-loop antenna for purposes of illustration. Some of the components shown in FIG. 11 can be excluded and additional components can be included depending on the design of the ear-worn electronic device.

The ear-worn electronic device 1102 includes an enclosure 1101 (e.g., a shell) and several components electrically connected to a mother flexible circuit 1103. A battery 1105 is electrically connected to the mother flexible circuit 1103 and provides power to the various components of the ear-worn electronic device 1102. Power management circuitry 1111 is coupled to the mother flexible circuit 1103. One or more microphones 1106 (e.g., a microphone array) are electrically connected to the mother flexible circuit 1103, which provides electrical communication between the microphones 1106 and a digital signal processor (DSP) 1104. Among other components, the DSP 1104 incorporates, or is coupled to, audio signal processing circuitry 1115. The DSP 1104 has an audio output stage coupled to a receiver 1112. The receiver 1112 (e.g., a speaker) transforms the electrical signal into an acoustic signal. An optional sensor arrangement 1120, which can include one or more physiologic sensors, is coupled to the DSP 1104 via the mother flexible circuit 1103. One or more user switches 1108 (e.g., on/off, volume, mic directional settings) are electrically coupled to the DSP 1104 via the flexible mother circuit 1103.

The ear-worn electronic device 1102 may incorporate a communication device 1107 coupled to the flexible mother circuit 1103 and to a combined dipole-loop antenna 1109. The communication device 1107 can be a Bluetooth® transceiver, such as a BLE transceiver or other transceiver (e.g., an IEEE 802.11 compliant device). The communication device 1107 can be configured to communicate with one or more external devices, such as a smartphone, tablet, laptop, TV, or streaming device. The communication device 1107 can be configured to communicate a communication device of another ear-worn electronic device to effect ear-to-ear communication.

A combined dipole-loop antenna of the present disclosure provides substantially constant antenna performance in terms of input impedance in response to variations in human head geometry and material properties. A combined dipole-loop antenna of the present disclosure can be self-tuned, and a matching network can be excluded when the loop and dipole structures of the antenna are appropriately tuned as described. A combined dipole-loop antenna of the present disclosure provides reliable wireless communication between an ear-worn electronic device and other handheld devices in cases where the material surrounding the ear-worn electronic device changes.

This document discloses numerous embodiments, including but not limited to the following:

Item 1 is an ear-worn electronic device, comprising:

an enclosure;

electronics positioned in the enclosure;

a power source in the enclosure and coupled to the electronics; and an antenna in or supported by the enclosure and coupled to the electronics, the antenna comprising a dipole antenna combined with a loop antenna;

wherein an input impedance of the antenna remains substantially constant over a predetermined dielectric constant bandwidth and a predetermined frequency bandwidth.

Item 2 is the device according to item 1, wherein the predetermined dielectric constant bandwidth comprises dielectric constants between about 10 and 80.

Item 3 is the device according to item 1, wherein the predetermined dielectric constant bandwidth comprises dielectric constants between about 20 and 50.

Item 4 is the device according to item 1, wherein the predetermined frequency bandwidth comprises frequencies between about 2.3 and 2.6 GHz.

Item 5 is the device according to item 1, wherein the dipole antenna has a length tuned for a predetermined center frequency and a predetermined center dielectric constant.

Item 6 is the device according to item 5, wherein the predetermined center dielectric constant is about 35.

Item 7 is the device according to item 6, wherein the predetermined center frequency is about 2.45 GHz.

Item 8 is the device according to item 1, wherein:

the loop antenna comprises a first loop and a second loop spaced apart from the first loop; and the dipole antenna is disposed between the first and second loops.

Item 9 is the device according to item 8, wherein:

the first loop is spaced apart from the dipole antenna by a first gap having a first width;

the second loop is spaced apart from the dipole antenna by a second gap having second width; and the first and second widths are selected to tune the antenna to resonance.

Item 10 is the device according to item 1, wherein an inductance of the loop antenna is substantially insensitive to changes in dielectric imposed by different human head loading.

Item 11 is an ear-worn electronic device, comprising:

an enclosure;

electronics positioned in the enclosure;

a power source in the enclosure and coupled to the electronics; and a folded antenna in or supported by the enclosure and coupled to the electronics, the folded antenna comprising:

a loop antenna comprising a first loop and a second loop;

a dipole antenna combined with the loop antenna and disposed between the first loop and the second loop;

a first gap defined between the first loop and the dipole antenna; and a second gap defined between the second loop and the dipole antenna.

Item 12 is the device according to item 11, wherein:

the first gap has a first width;

the second gap has a second width; and the first and second widths are selected to tune the antenna to resonance.

Item 13 is the device according to item 12, wherein the dipole antenna has a length tuned for a predetermined center dielectric constant and a predetermined center frequency.

Item 14 is the device according to item 13, wherein the predetermined center dielectric constant is about 35.

Item 15 is the device according to item 14, wherein the predetermined center frequency is about 2.45 GHz.

Item 16 is the device according to item 11, wherein an input impedance of the antenna remains substantially constant over a predetermined dielectric constant bandwidth and a predetermined frequency bandwidth.

Item 17 is the device according to item 16, wherein the predetermined dielectric constant bandwidth comprises dielectric constants between about 10 and 80.

Item 18 is the device according to item 16, wherein the predetermined dielectric constant bandwidth comprises dielectric constants between about 20 and 50.

Item 19 is the device according to item 16, wherein the predetermined frequency bandwidth comprises frequencies between about 2.3 and 2.6 GHz.

Item 20 is the device according to item 11, wherein an inductance of the loop antenna is substantially insensitive to changes in dielectric imposed by different human head loading.

Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. An ear-worn electronic device, comprising:

an enclosure;

electronics positioned in the enclosure;

a power source in the enclosure and coupled to the electronics; and an antenna in or supported by the enclosure and coupled to the electronics, the antenna comprising a dipole antenna combined with a loop antenna;

wherein an input impedance of the antenna remains substantially constant over a predetermined dielectric constant bandwidth and a predetermined frequency bandwidth.

2. The device according to claim 1, wherein the predetermined dielectric constant bandwidth comprises dielectric constants between about 10 and 80.

3. The device according to claim 1, wherein the predetermined dielectric constant bandwidth comprises dielectric constants between about 20 and 50.

4. The device according to claim 1, wherein the predetermined frequency bandwidth comprises frequencies between about 2.3 and 2.6 GHz.

5. The device according to claim 1, wherein the dipole antenna has a length tuned for a predetermined center frequency and a predetermined center dielectric constant.

6. The device according to claim 5, wherein the predetermined center dielectric constant is about 35.

7. The device according to claim 6, wherein the predetermined center frequency is about 2.45 GHz.

8. The device according to claim 1, wherein:

the loop antenna comprises a first loop and a second loop spaced apart from the first loop; and the dipole antenna is disposed between the first and second loops.

9. The device according to claim 8, wherein:

the first loop is spaced apart from the dipole antenna by a first gap having a first width;

the second loop is spaced apart from the dipole antenna by a second gap having second width; and the first and second widths are selected to tune the antenna to resonance.

10. The device according to claim 1, wherein an inductance of the loop antenna is substantially insensitive to changes in dielectric imposed by different human head loading.

11. An ear-worn electronic device, comprising:

an enclosure;

electronics positioned in the enclosure;

a power source in the enclosure and coupled to the electronics; and a folded antenna in or supported by the enclosure and coupled to the electronics, the folded antenna comprising:

a loop antenna comprising a first loop and a second loop;

a dipole antenna combined with the loop antenna and disposed between the first loop and the second loop;

a first gap defined between the first loop and the dipole antenna; and a second gap defined between the second loop and the dipole antenna.

12. The device according to claim 11, wherein:

the first gap has a first width;

the second gap has a second width; and the first and second widths are selected to tune the antenna to resonance.

13. The device according to claim 12, wherein the dipole antenna has a length tuned for a predetermined center dielectric constant and a predetermined center frequency.

14. The device according to claim 13, wherein the predetermined center dielectric constant is about 35.

15. The device according to claim 14, wherein the predetermined center frequency is about 2.45 GHz.

16. The device according to claim 11, wherein an input impedance of the antenna remains substantially constant over a predetermined dielectric constant bandwidth and a predetermined frequency bandwidth.

17. The device according to claim 16, wherein the predetermined dielectric constant bandwidth comprises dielectric constants between about 10 and 80.

18. The device according to claim 16, wherein the predetermined dielectric constant bandwidth comprises dielectric constants between about 15 and 50.

19. The device according to claim 16, wherein the predetermined frequency bandwidth comprises frequencies between about 2.3 and 2.6 GHz.

20. The device according to claim 11, wherein an inductance of the loop antenna is substantially insensitive to changes in dielectric imposed by different human head loading.

* * * * *